US011480174B2

(12) United States Patent
Nalini

(10) Patent No.: US 11,480,174 B2
(45) Date of Patent: Oct. 25, 2022

(54) COMPRESSOR UNIT FOR REFRIGERATING MACHINE FOR DOMESTIC OR COMMERCIAL USE AND REFRIGERATING MACHINE FOR DOMESTIC OR COMMERCIAL USE WHICH COMPRISES IT

(71) Applicant: CAREL INDUSTRIES S.p.A., Brugine (IT)

(72) Inventor: Luigi Nalini, Brugine (IT)

(73) Assignee: CAREL INDUSTRIES S.P.A., Brugine (IT)

( * ) Notice: Subject to any disclaimer, the term of this patent is extended or adjusted under 35 U.S.C. 154(b) by 47 days.

(21) Appl. No.: 16/524,936

(22) Filed: Jul. 29, 2019

(65) Prior Publication Data

US 2020/0040891 A1 Feb. 6, 2020

(30) Foreign Application Priority Data

Jul. 31, 2018 (IT) ..... 102018000007655

(51) Int. Cl.
*F04C 18/02* (2006.01)
*F01C 21/08* (2006.01)
(Continued)

(52) U.S. Cl.
CPC ..... *F04C 18/0215* (2013.01); *F01C 21/08* (2013.01); *F01C 21/10* (2013.01);
(Continued)

(58) Field of Classification Search
CPC .. F04C 28/28; F04C 2240/30; F04C 2240/40; F01C 21/08; F01C 21/10
See application file for complete search history.

(56) References Cited

U.S. PATENT DOCUMENTS 4,258,821 A * 3/1981 Wendt ..... F04D 29/664 181/202
4,991,406 A * 2/1991 Fujii ..... F24F 1/56 62/259.1

(Continued)

FOREIGN PATENT DOCUMENTS

EP 2505776 A2 10/2012
EP 2947322 A1 11/2015
JP 2013194673 A 9/2013

OTHER PUBLICATIONS

Italian Search Report dated Feb. 11, 2019 from Italian Application No. it 201800007655.

*Primary Examiner* — Connor J Tremarche
(74) *Attorney, Agent, or Firm* — Innovation Capital Law Group, LLP; Vic Lin

(57) ABSTRACT

A compressor unit (10) of a refrigerating machine (100) for domestic or commercial use has a rotary compressor (11) which has a BLDC or BLAC motor (13), connected to a compression element (12) for actuating it, and a control device (16) connected to the motor (13), for driving it at a variable speed. The compressor (11) further has a a housing (17) which encloses the motor (13) and the compression element (16) and which has a side wall (20) inside of which the stator (14) of the motor (13) is fixed. The compressor unit (10) also comprises an operating shell (21) covering the housing (17) and in thermal communication with the side wall (20). The operating shell (21) dissipates heat transmitted to it by the housing (17) and contrasts or absorbs or dissipate sound waves having a frequency of between 4 kHz and 16 kHz.

11 Claims, 3 Drawing Sheets

(51) Int. Cl.
*F01C 21/10* (2006.01)
*F04C 28/28* (2006.01)

(52) U.S. Cl.
CPC ..... *F04C 28/28* (2013.01); *F04C 2240/30* (2013.01); *F04C 2240/40* (2013.01)

(56) References Cited

U.S. PATENT DOCUMENTS

| | | | | |
|---|---|---|---|---|
| 7,481,296 | B2 * | 1/2009 | Eilers | A47J 42/38 181/200 |
| 7,549,505 | B1 * | 6/2009 | Kawar | G06F 1/18 181/202 |
| 8,640,819 | B2 * | 2/2014 | Seedorf | F04D 29/664 181/205 |
| 9,777,944 | B2 * | 10/2017 | Mehta | F04D 29/664 |
| 2005/0056481 | A1 * | 3/2005 | Mafi | F24F 1/56 181/202 |
| 2005/0274569 | A1 * | 12/2005 | Seel | F04C 29/066 181/202 |
| 2008/0099275 | A1 * | 5/2008 | Seel | F04B 39/0033 181/202 |
| 2012/0118000 | A1 * | 5/2012 | Chae | F25D 23/006 62/296 |
| 2013/0140933 | A1 * | 6/2013 | Katsuhisa | H02K 1/276 310/156.08 |
| 2014/0271242 | A1 | 9/2014 | Calhoun et al. | |

* cited by examiner

COMPRESSOR UNIT FOR REFRIGERATING MACHINE FOR DOMESTIC OR COMMERCIAL USE AND REFRIGERATING MACHINE FOR DOMESTIC OR COMMERCIAL USE WHICH COMPRISES IT

BACKGROUND OF THE INVENTION

This invention relates to a compressor unit for a refrigerating machine and a refrigerating machine which comprises it.

In particular, the invention relates to a rotary compressor unit for refrigerating machines, especially for refrigerating machines intended to be installed in domestic or commercial contexts such as shops, bars, restaurants and the like.

Specifically, the compressor unit according to the invention is designed to be incorporated in refrigerating machines of chiller counters, domestic refrigerators, cooler cabinets for food products or drinks, bottle coolers and vending machines in general.

SUMMARY OF THE INVENTION

In the field of these refrigerating machines, to which this description refers to as machines for domestic or commercial use, piston-type compressors are currently used which satisfy two specific requirements.

A first requirement is that they are quiet and a second requirement is that they are economical, that is to say, structurally simple.

Clearly, this requirement is not felt in the field of industrial applications where the problem of noise in the environments is limited.

In this regard, the invention is to be considered specifically and exclusively applied to compressors for domestic or commercial use and not to refrigerating machines for industrial use, that is to say, refrigerating machines to be installed in environments used for living purposes or for professional or commercial activities.

A need which is currently increasingly felt in the sector of the machines for domestic and commercial use is that of reducing the energy consumption of the machines.

The problem at the basis of the invention is to reduce the consumption and/or the energy efficiency with respect to traditional compressor units of refrigerating machine for domestic or commercial use and refrigerating machine for domestic or commercial use.

The aim of the invention is to overcome this problem especially providing a compressor unit of a refrigerating machine for domestic or commercial use and a refrigerating machine for domestic or commercial use which allow the energy consumption to be reduced in line with the performance levels of the refrigerating machine.

Within this task, an aim of the invention is to provide a compressor unit of a refrigerating machine for domestic or commercial use and a refrigerating machine for domestic or commercial use which are considerably less noisy than the traditional ones, whilst increasing the energy efficiency and/or reducing the energy consumption in line with the performance levels.

Another aim of the invention consists in making a compressor unit of a refrigerating machine for domestic or commercial use and a refrigerating machine for domestic or commercial use which are at least as equally durable, reliable and safe as the traditional compressors and relative machines.

This aim, as well as these and other aims which will emerge more fully below, are attained by a compressor unit of a refrigerating machine for domestic or commercial use and a refrigerating machine for domestic or commercial use according to appended claim 1.

Detailed features of a compressor unit of a refrigerating machine for domestic or commercial use and a refrigerating machine for domestic or commercial use according to the invention are indicated in the dependent claims.

BRIEF DESCRIPTION OF THE DRAWINGS

Further features and advantages of the invention will emerge more fully from the description of a preferred but not exclusive embodiment of a compressor unit for a refrigerating machine for domestic or commercial use and a refrigerating machine for domestic or commercial use according to the invention, illustrated by way of non-limiting example in the accompanying drawings, in which.

DETAILED DESCRIPTION OF THE PREFERRED EMBODIMENTS

Figure 1:
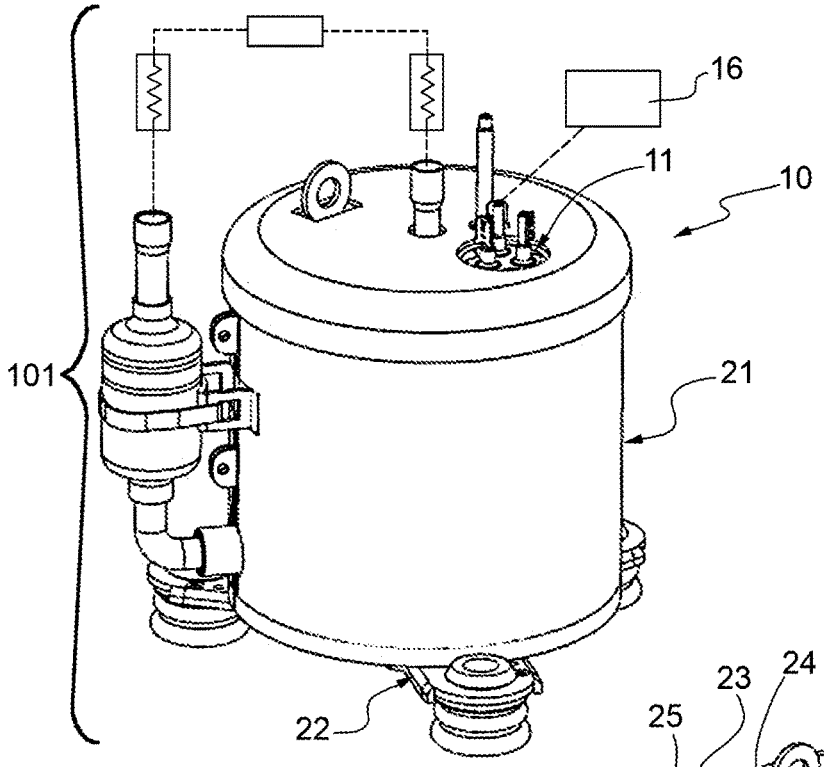
FIG. 1 illustrates a perspective view of a compressor unit according to the invention.
Figure 2:
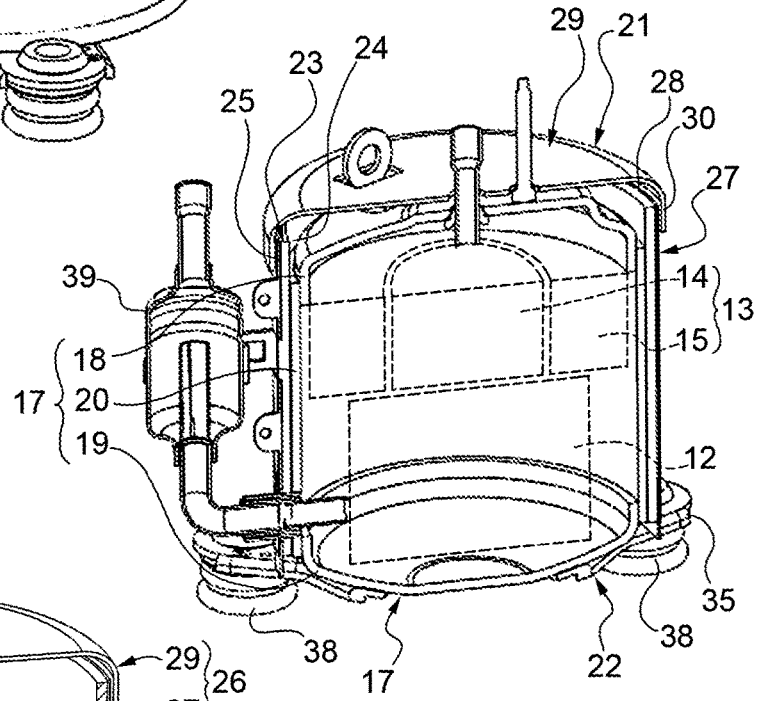
FIG. 2 illustrates a cross-section view through a vertical and central plane of the compressor unit of FIG. 1.
Figure 3:
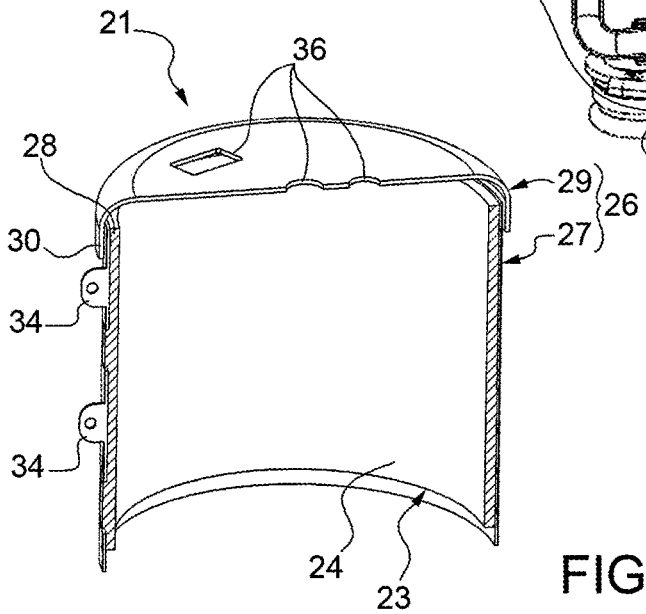
FIG. 3 illustrates a perspective cross-section view of a component of the compressor unit of the previous drawings relative to the operating shell.
Figure 4:
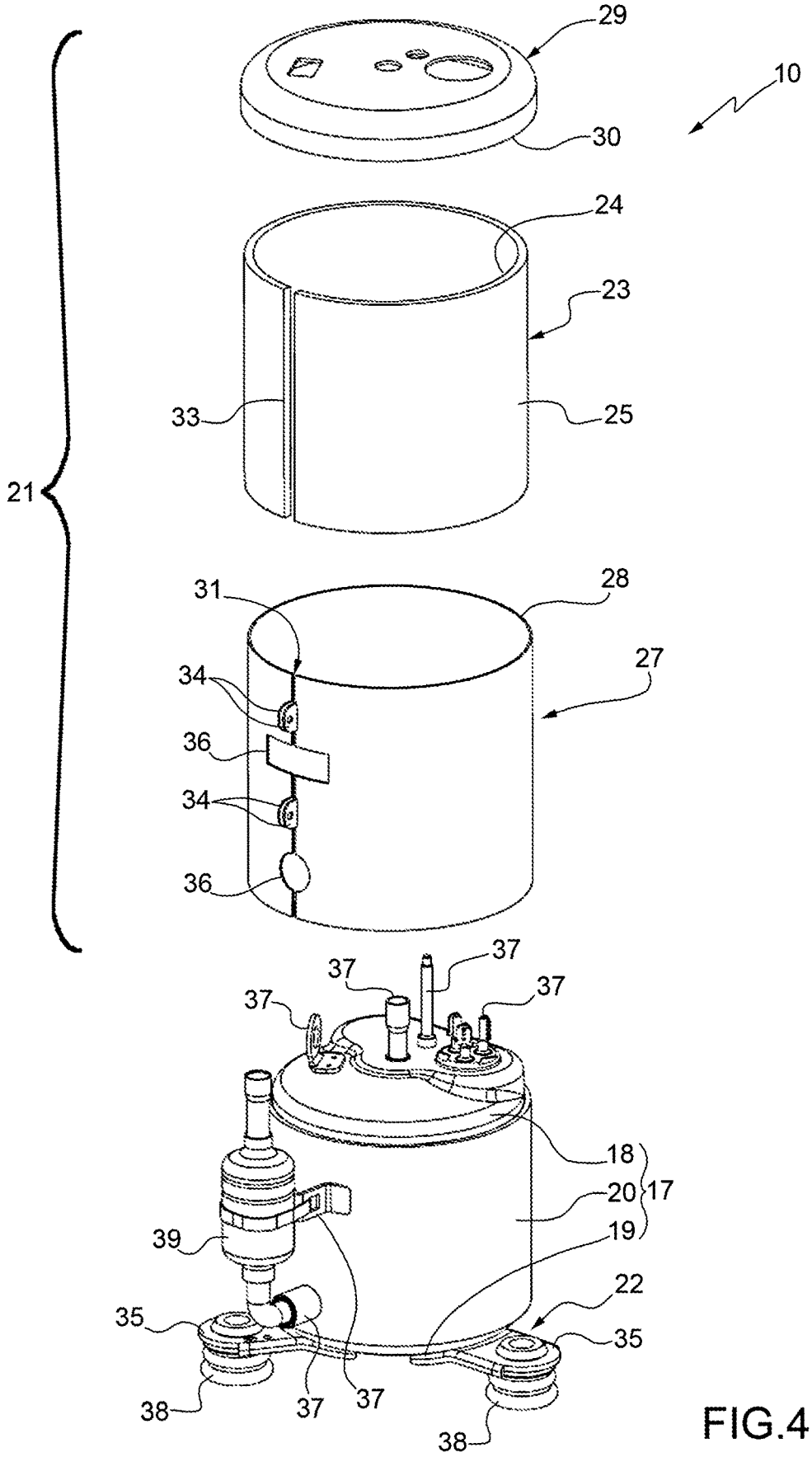
FIG. 4 illustrates an exploded perspective view of the compressor unit of FIGS. 1 and 2.
Figure 5:
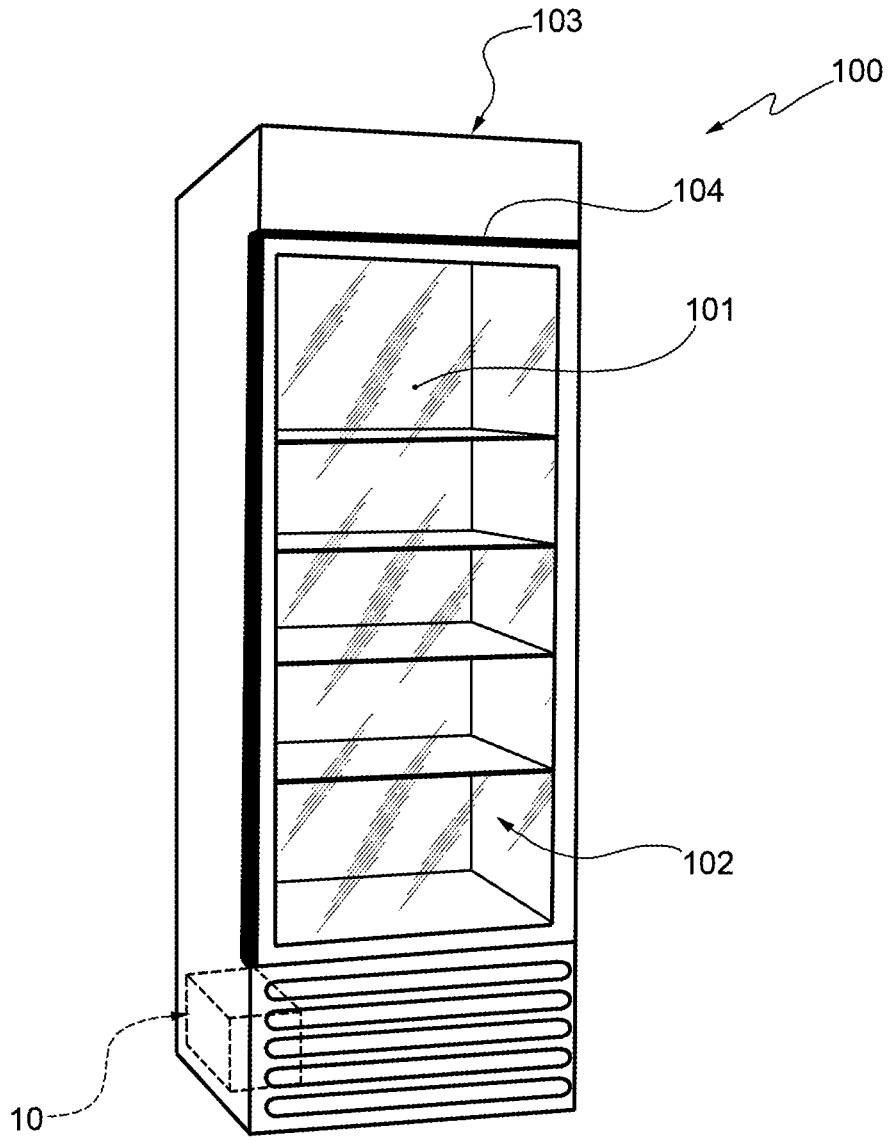
FIG. 5 illustrates a schematic and perspective view of a possible embodiment of a refrigerating machine according to this invention.

With particular reference to the above-mentioned drawings, the numeral 10 denotes in its entirety a compressor unit of a refrigerating machine 100 for domestic or commercial use which comprises a rotary compressor 11 having:

- a compression element (12);
- un motor 13 with permanent brushless magnets, preferably sensorless, with direct or alternating current, known commercially by the acronym BLDC (BrushLess Direct Current) or BLAC (BrushLess Alternating Current), having, in a traditional manner, a stator 14 and a rotor 15, inside the stator 14, and connected to the compression element 12 for actuating it;
- a control device 16 comprising an inverter, connected to the motor 13 for driving it at a variable speed;
- a housing 17 which encloses the motor 13 and the compression element 12 and which advantageously comprises an upper wall 18, a lower wall 19 and a side wall 20, preferably tubular, which extends from the upper wall 18 to the lower wall 19.

In a traditional manner, the stator 14 is fixed inside the side wall 20 so that the stator is substantially anchored to the side wall 20 and to the housing 17 in general.

The compressor unit 10, according to the invention, has a peculiarity in that it also comprises an operating shell 21 which covers, at least partly, the housing 17 and which advantageously is in thermal contact with the side wall 20 to receive a thermal flow from this.

Preferably, the operating shell 21 is configured in such a way as to dissipate heat transmitted to it, during operation of the compressor 10, from the housing 17, to prevent overheating of the compressor 11 when it is in operation.

According to a possible embodiment, the operating shell 21 will have a thermal conductivity of 40 W/($m^2$·K).

Moreover, the operating shell 21 is also advantageously configured in such a way as to contrast the transmission, through it, of sound waves having a frequency of between 4 kHz and 16 kHz or to absorb or dissipate said sound waves.

In this way, the compressor unit 10, when it is in operation, is much more efficient than traditional piston-type compressor units, whilst having noise emissions which are not greater than the latter, and possibly less.

In fact, the operating shell contrasts the emission, in particular, of the annoying noise emissions which the rotary compressor 11 tends to emit especially at the traditional switching frequencies of the inverter of the control device 16.

The driving of the motor 13 at a variable speed allows a very efficient energy control of the compressor unit 10 so as to allow high levels of energy saving compared with the use of a traditional piston-type compressor.

From the structural point of view, some embodiments of the compressor unit 10 can comprise a base 22, for resting it on a supporting surface, wherein the base 22 is preferably fixed to the lower wall 19 of the housing 17.

In order to maximise the reduction of annoying noise emissions, whilst optimising the structural simplicity and the simplicity of making and installing the compressor unit 10, the operating shell 21 can be configured so as to cover the upper wall 18 and, at least partially but preferably entirely, the side wall 20.

According to some embodiments of the invention, the operating shell 21 can be in contact with the upper wall 18 of the housing 17, whilst according to other embodiments it can be spaced from it so as to form a gap between them.

Moreover, according to some embodiments of the invention, for reasons of structural simplicity, the operating shell 21 can comprise an operating layer 23 preferably made of foam-type material and advantageously sound absorbent.

The operating layer 23 can have a first face 24 in thermal contact with the side wall 20 and/or with the upper wall 18 of the housing 17.

In particular, the operating layer 23 can be configured so as to maximise the surface of reciprocal contact between it and the side wall 20 and/or with the upper all 18, to maximise the thermal conduction through the operating layer 20.

In order to increase the safety of the compressor unit 10, the operating layer 23 will advantageously be made of or comprise fire-retardant material.

Specifically, the sound absorbent foam-type material will preferably also be fire-retardant.

Accordingly, in a possible embodiment, the sound absorbent foam-type material can comprise a melamine resin foam or consist entirely of melamine resin foam.

The operating shell 21 can also comprises a structural wall 26 made of metallic material or polymeric material, preferably rigid, which covers a second face 25 of the operating layer 23.

According to some embodiments of the invention, the operating layer 23 is fixed to the structural wall to form a unitary product and thereby increase the ease of handling and installation.

According to some embodiments, according to the invention, the structural wall 26 comprises:

- a jacket 27, if necessary tubular, configured for retaining the operating layer 23 in thermal contact with the side wall 20 of the housing 17 and having an upper edge 28;
- a cap 29 configured for being superposed on the upper wall 18 of the housing 17 and having a collar 30 shaped to match the upper edge 28 of the jacket 27 for being joined to the latter by means of a shape coupling.

The jacket 27, according to possible embodiments of the invention, can have a longitudinal cut 31 which extends between the upper edge 28 and a lower edge 32 of the jacket 27.

Preferably, the jacket 27 is deformable for fitting on the housing 17 or for being removed from it.

There can also be closing means, for example bolts or screws not illustrated, configured for being actuated so as to exert on the jacket 27 a stress aimed at closing the cut 31, for tightening the jacket 27 on the operating layer 23 and, therefore, against the housing 17.

In that case, the operating layer 23 will have or will consist of a tubular cylindrical part which advantageously will have a longitudinal slot 33 shaped and positioned in such a way that when the operating layer 23 is coupled to the jacket 27, with its second face 25 in contact with an inner face of the jacket 27, the slot 33 and the cut 31 are reciprocally superposed or, in any case, can be superposed.

According to the possible embodiment illustrated in the accompanying drawings, merely by way of example and not limiting the scope of the invention, both the jacket 27 and the operating layer 23 have a tubular cylindrical shape and their shapes can advantageously be superposed and preferably configured for covering, possibly—but not necessarily—entirely, the side wall 20 of the compressor 11 and possibly also, at least partly, the upper wall 18 and/or the lower wall 19.

The frame 31 and/or the slot 33 can extend along a generatrix of the cylindrical extension of, respectively, the jacket 27 and/or the operating layer 23.

The said closing means can comprise:

- brackets 34 which can be integral with the flaps of the cut 31;
- neck-in means, which can be of traditional type, such as, for example, bolts or screws, not illustrated, which can be actuated to force the brackets 34 against each other.

Preferably, the base 22 will comprise legs 35 which advantageously extend from the lower wall 19 of the housing 17.

The base can also comprise shock absorbing feet 38, which can comprise or consist of elastomeric material, configured for damping vibrations which, when the compressor unit 10 is in operation, can be transmitted through the legs 35.

According to some embodiments of the invention, the operating shell 21 can make contact against the legs 35 which can thereby act as an end for inserting the operating shell 21 on the compressor 11.

According to some embodiments of the invention, the operating shell 21, can have one or more through openings, generically denoted with numeral 36 in the accompanying drawings, configured and positioned to be passed through by operating elements of the compressor 11, generically denoted with numeral 37 in the accompanying drawings, wherein the operating elements 37 can comprise or consist of coolant suction and/or supply hoses, one or more probes or connections for them, and/or electrical connectors for connecting the motor 13 to the control device 16, and/or support brackets for auxiliary elements, such as an oil separator 39, or for attaching the compressor 11 itself, or the like.

An object of the invention is also a refrigerating machine 100 which preferably comprises, in a traditional manner and not illustrated:

a frame, not illustrated, and operating structure (101) fixed to the frame and defining at least one compartment (102) configured for housing food and/or drink to be cooled, a refrigerating device 103, thermally connected to the compartment 102 for cooing it, a cover 103 equipped with an opening 104 facing the compartment 102 to allow access to the latter.

The cover 103 is fixed to the frame and configured for enclosing in it, preferably entirely, the refrigerating device 103 and the operating structure 101.

The refrigerating machine 100, according to the invention, has a peculiarity in that the refrigerating device 103 comprise a compressor unit 10 as described above. The refrigerating machine 100 according to some embodiments of the invention can consist of a chiller counter for commercial use or a refrigerator for domestic use or also a bottle cooler or an automatic vending machine of food and/or drink, or similar machines designed to be located in environments for commercial or professional use.

The installation of a compressor unit 10 according to the invention is particularly simple as it is sufficient to install the compressor 11, in a traditional manner, and fit above it the operating shell 21 taking care to align any through openings 36 to the operating elements 37 of the compressor 11.

The jacket 27, which, advantageously, is elastically deformable for opening the cut 31 and more easily fitting on the compressor 11, can be tightened on the compressor 11, together with the operating layer 23, by actuating the closing means, so as to press the operating layer 23 against the housing 17 of the compressor 11 in order to optimise the surface of reciprocal contact and, consequently, the transmission of heat between them.

The cap 29 can be joined to the jacket 27 simply by coupling the collar to the upper edge 28.

It should be noted that according to some embodiments of the invention, such as the example embodiment illustrated in the accompanying drawings, the operating shell 21 does not cover the lower part 19 of the housing 17.

This has surprisingly been found to not adversely affect the quietness of the compressor unit 10, also allowing a particularly simple structure of the operating shell 21 to be adopted which makes the use particularly easy.

It can be understood from the above description how a compressor unit of a refrigerating machine for domestic or commercial use and a refrigerating machine for domestic or commercial use attains the set purpose and aims allowing the energy consumptions to be reduced with the same performance levels as the refrigerating machine thereby making available, for use in refrigerating machines for domestic or commercial use, the use of a rotary compressor controlled by an inverter overcoming the problem of the noise of these devices.

In addition, a compressor unit of a refrigerating machine for domestic or commercial use and a refrigerating machine for domestic or commercial use, according to the invention, is not noisier than the traditional ones, whilst increasing the energy efficiency and/or reducing the energy consumption in line with the performance levels.

Again, a compressor unit of a refrigerating machine for domestic or commercial use and a refrigerating machine for domestic or commercial use are at least as equally durable, reliable and safe as the traditional compressors and relative machines.

The invention claimed is:

1. A compressor unit (10) of a refrigerating machine (100) for domestic or commercial use which comprises a rotary compressor (11) having:

a compression element (12), a brushless motor (13) with permanent magnets, having a stator (14) and a rotor (15) which is inside said stator (14) and connected to said compression element (12) to actuate it, a control device (16) connected to said motor (13), for driving it at a variable speed;

a housing (17) which encloses said motor (13) and said compression element (16) and which comprises a side wall (20) inside of which said stator (14) is fixed;

said compressor unit (10) also comprising an operating shell (21) covering said housing (17) and in thermal contact with said side wall (20);

said operating shell including an operating layer (23) having a first face (24) in direct contact with said side wall (20) and/or with an upper wall (18) of said housing (17);

said operating shell (21) further comprises a structural wall (26) made of a metallic material, which covers a second face (25) of said operating layer (23), the structural wall (26) defining an exposed exterior surface of the operating shell;

said operating shell (21) being configured in such a way as to increase the dissipation of heat transmitted to it by said housing (17) and in such a way as to contrast the transmission through it of sound waves having a frequency of between 4 kHz and 16 kHz or to absorb or dissipate said sound waves.

2. The compressor unit (10) according to claim 1, which comprises a base (22), for resting on a supporting surface, said base (22) being fixed to a lower wall (19) of said housing (17); said operating shell (21) being configured in such a way as to cover the upper wall (18) of said housing (17) and said side wall (20).

3. The compressor unit (10) according to claim 2, wherein said operating shell (21) is in thermal contact with the upper wall (18) of said housing (17).

4. The compressor unit (10) according to claim 2, wherein the operating layer (23) is made of sound absorbent foam-type material.

5. The compressor unit (10) according to claim 3, wherein the operating layer (23) is made of sound absorbent foam-type material.

6. The compressor unit (10) according to claim 4, wherein said sound absorbent foam-type material comprises a melamine resin foam.

7. The compressor unit (10) according to claim 5, wherein said sound absorbent foam-type material comprises a melamine resin foam.

8. The compressor unit (10) according to claim 1, wherein said structural wall (26) comprises:

a tubular jacket (27), configured for retaining said operating layer (23) in thermal contact with the side wall (20) of said housing (17) and having an upper edge (28);

a cap (29) configured for being superposed on the upper wall (18) of said housing (17) and having a collar (30) shaped to match the upper edge (28) of said jacket (27) for being joined to the latter by means of a shape coupling.

9. The compressor unit (10) according to claim 8, wherein said jacket (27) has a longitudinal cut (31) which extends between said upper edge (28) and a lower edge (32) and is deformable for being fitted on said housing (17) and removed from it; there being closing means configured for being actuated so as to exert on said jacket (27) a stress aimed at bringing ends of the jacket formed by said longitudinal cut (31) together, for tightening said jacket (27) on said operating layer (23).

10. The compressor unit (10) according to claim 9, wherein said closing means comprise brackets (34) integral with flaps of said cut (31) and neck-in means which can be actuated to force said brackets (34) against each other.

11. A refrigerating machine (100) which comprises:

a frame, and operating structure (101) fixed to said frame and defining at least one compartment (102) configured for housing food and/or drink to be cooled, a refrigerating device (103) thermally connected to said at least one compartment (102) for cooing it and equipped with a compressor unit (10) according to claim 1, a cover (103) fixed to said frame and equipped with an opening (104) facing said compartment (102) for allowing access, said cover (103) being fixed to said frame and configured for enclosing said refrigerating device (103) and said operating structure (101).

* * * * *